United States Patent [19]

Meunier

[11] Patent Number: 4,592,151

[45] Date of Patent: Jun. 3, 1986

[54] PACKING ELEMENTS FOR DEVICE FOR COUNTERCURRENT EXCHANGE, PARTICULARLY HEAT EXCHANGE, BETWEEN SOLID PARTICLES AND A GAS CURRENT

[75] Inventor: Georges Meunier, Nice, France

[73] Assignee: Tunzini-Nessi Entreprises d'Equipments, Argenteuil, France

[21] Appl. No.: 637,787

[22] Filed: Aug. 6, 1984

[30] Foreign Application Priority Data

Aug. 4, 1983 [FR] France ..... 83 12844

[51] Int. Cl.[4] ..... F26B 17/14

[52] U.S. Cl. ..... 34/168; 34/170; 34/171; 432/96

[58] Field of Search ..... 34/10, 57 A, 170, 168, 34/171; 432/15, 58; 110/245; 432/96, 100

[56] References Cited

U.S. PATENT DOCUMENTS

| | | | |
|---|---|---|---|
| 3,373,503 | 3/1968 | Kune et al. | 34/170 |
| 3,710,453 | 1/1973 | Whelpley . | |
| 4,039,290 | 8/1977 | Inade et al. | 34/57 A |
| 4,423,558 | 1/1984 | Meunier | 34/57 A |
| 4,450,895 | 5/1984 | Meunier et al. | 34/57 A |

FOREIGN PATENT DOCUMENTS

| | | |
|---|---|---|
| 2498080 | 1/1981 | France . |
| 788775 | 4/1956 | United Kingdom . |
| 805387 | 12/1956 | United Kingdom . |
| 1154041 | 7/1966 | United Kingdom . |
| 1264111 | 10/1967 | United Kingdom . |

*Primary Examiner*—Larry I. Schwartz

*Attorney, Agent, or Firm*—Oblon, Fisher, Spivak, McCelland & Maier

[57] ABSTRACT

Packing for a column for treating solid particles by direct contact between an ascending gas current and solid particles flowing countercurrent by gravity within the packing. The packing has an ordered structure, consisting of superposition of at least two stacking elements (1,12), each comprising shaped elements (2, 9) arranged parallel between themselves and with regular spacing, said spacing providing a passage opening between two neighboring shapes between 3 and 20 times, preferably 7 and 15 times, the average granulometry of said particles, and the vertical projection of the shaped elements completely covering a horizontal section of the column. This packing is very specially recommended in the presence of particles with a granulometry greater than 2 mm or having mediocre flow characteristics.

18 Claims, 7 Drawing Figures

PACKING ELEMENTS FOR DEVICE FOR COUNTERCURRENT EXCHANGE, PARTICULARLY HEAT EXCHANGE, BETWEEN SOLID PARTICLES AND A GAS CURRENT

BACKGROUND OF THE INVENTION

This invention relates to packing elements for exchange columns, particularly heat exchange columns, intended more particularly for countercurrent exchanges by putting a gas current and solid particles flowing by gravity in direct contact within the packing.

It relates very particularly to the processes and devices described in U.S. Pat. Nos. 4,423,558 and 4,450,895 which resort to the average speeds of gas currents within the packing, preferably on the order of the maximum free fall speed of the particles.

Actually it has been found that packing elements currently used for exchanges between gases and liquids of the Pall ring type, obtained by the operations of cutting plates, provided with various notches, from steel sheet, then by shaping operations generally leading to cylinders provided with lugs on the inside, do not always obtain totally satisfactory results for gas-solid exchangers of the type described in the patents cited above. In the presence of particles with mediocre flow characteristics, particularly because of their shape and/or high granulometries, use of these elements actually, particularly for high speeds aimed according to the teachings of U.S. Pat. No. 4,423,558 at optimizing the efficiency of the exchanger, makes it possible to observe a trapping of the particles by the packing elements, leading to an increase in the retention of particles within the packing, and consequently to an increase in the pressure drop of the gas current through the packing and especially to a segregation of the particles, or even complete clogging of the exchange column.

For example, when the Pall rings of heat-resistant steel sheet, 25 mm in diameter and 25 mm high, are placed loose on a support consisting of a large-mesh (60×20 mm) grill formed with heat-resistant steel strips 15×1 mm, set edgewise and spot welded, particles, for example, silica or zirconia sands, even fairly spherical, with average granulometries greater than 2 mm, cannot be reliably treated under the conditions provided by the process of patent U.S. Pat. No. 4,423,558 because generally a complete clogging of the column is very quickly observed. Similar difficulties arise sooner or later, in industrial practice, when the product to be treated, even with an average granulometry much less than the critical value of 2 mm given above, contains some particles greater than 2 mm, either because they have escaped the preparatory grinding and screening operations or because they result from a process of uncontrolled agglomeration of the fine particles.

A certain improvement has been noted, especially in regard to the appearance of the phenomena of clogging the rings by particles, when these packing elements are placed on their support not loose but in an ordered manner, their axis of revolution being vertical; however, other drawbacks are then observed, particularly in regard to the efficiency of the treatment, as a result of spatial segregation, generally radial, between the particles and gas current, and a direct flow of the solid without slowdown.

SUMMARY OF THE INVENTION

This invention aims at avoiding these drawbacks by proposing a packing for a column for treating solid particles by direct contact between an ascending gas current and solid particles flowing countercurrent by gravity within the packing, said packing having an ordered structure, consisting of superposition of at least two stacking and packing elements, each comprising shaped elements or shapes arranged parallel to one another and with regular spacing, said spacing providing a passage opening between two neigboring shapes between 3 and 20 times, preferably 7 and 15 times, the average granulometry of said particles, and the vertical projection of said shapes completely covering a horizontal section of the column.

To treat irregularly shaped particles, for example, lamellar, the packing will advantageously be provided with a passage opening between two neighboring shapes at least equal to twice the largest dimension of the particles.

The shapes preferably comprise at least two distinct ribs, forming between them an angle imposing changes in direction on the gas and solid flow. Said ribs advantageously exhibit a width between 1 and 4 times the passage opening between neighboring shapes.

Further, particularly to slow down the flow of particles within the packing, the slope of at least one of the ribs of each shape is selected to be less than 1.5 times the slope of the angle of talus of the solid particles to be treated. This limit will advantageously be brought to 0.8 when the device is provided to treat very abrasive particles, so that the upper surface of the ribs is in some way protected by an almost permanent layer of particles. On the other hand, when abrasion of the ribs by the particles is not feared, the slope of the ribs in relation to the horizontal will advantageously be selected between 0.8 and 1.2 times the slope of the angle of talus of the particles.

Again preferably, the shapes will be placed so that the entire vertical plane parallel to said shapes cuts two ribs of the same elememt along a shape generatrix; as much benefit as possible is taken of the fact that at the lower edge of each rib there is a mutual intersection with turbulence of the particle and gas flows which avoids any undesired formation of agglomerates and promotes mixing between the phases.

Generally, the assembly of the elements to be superposed in the column is provided so as to promote the division of the solid particle and gas flows and to minimize the possibilities of radial segregation.

For this purpose, the packing elements are placed one above the other so that the shapes of an element are crossed, i.e., not parallel, in relation to those of the immediately neighboring elements. In the absence of symmetry of ribs, for the same shape, in relation to a vertical plane parallel to the shapes, and more generally when the solid particles going through a packing element are subjected to a movement having a non-null horizontal component, the superposed elements will preferably be oriented with an angular offset from one another of such magnitude and sign that the sum of the angular offsets of the packing elements is equal to 0 or to a whole number times 360°, i.e., selected so as to cancel, for a stack of elements, the resultant of the horizontal components due to the various elements making up the stack. For example, in a simple way, a stack will advantageously be chosen comprising a number of elements that is a multiple of 4, and each element will be placed above the preceding one so that their respective shapes form an angle of 90° between them, the direction of rotation from one element to the next being kept so that the elements are in the same orientation every four elements. Under these conditions, prefabricated elements with parallelepipedal shape provided with means for automatic mutual positioning will advantageously be adopted. In this connection, some forms of shapes will be preferably selected because of ease in assembling them, particularly by providing them with notches making it possible to put the shapes of the element or elements in an immediately higher and/or lower position and maintain them.

BRIEF DESCRIPTION OF THE DRAWINGS

Various embodiments of the packing according to the invention will now be described, by way of nonlimiting examples, with reference to the drawings which.

The device of a first embodiment is proposed to treat lamellar particles, such as certain by-products of the coal industry, very rich in schists, whose dimensions vary between 0 and 10 mm, and more precisely having the following granulometric anaylsis: of the particles of the sample:

17% exhibit a dimension greater than 5 mm,
46% exhibit a dimension greater than 2 mm,
72% exhibit a dimension greater than 1 mm, and
91% exhibit a dimension greater than 0.5 mm, with a median close to 2. Further, the angle of talus of fall of this product is about 35°, and its specific heat is $1.05 \cdot 10^3$J/(kg.K).

This product has shown that it very quickly clogs loose Pall ring packings of 25 or even 50 mm in diameter, whereas the packing described in this example makes it possible to treat them very effectively.

Figure 1:
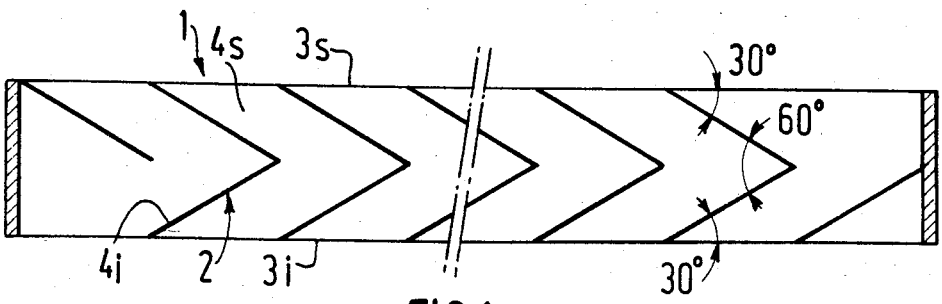
FIG. 1 is a partial view, in elevation, in section along a plane orthogonal to the shapes, of a packing element according to the invention, with V-section shapes.

This packing consists of superposed stacking elements 1, comprising shaped elements or shapes 2, obtained by bending heat-resisting steel sheet with a thickness on the order of 1 mm, for example, of the type defined by French standards under the designation Z 12 CN 25/20, arranged parallel to the inside of a square-shaped frame 3 three of whose sides can be seen in FIG. 1.

Each shape 2 exhibits a V section whose legs are each located on the same side in relation to the vertical plane going through its summit, and more precisely, in the present case, comprises two ribs, lower rib **4*i* and upper rib 4*s*, forming a 60° angle between them, and welded by their ends to frame 3 so that said ribs form a 30° angle in relation, respectively, to the lower faces 3*i* and upper faces 3*s*** of the element to which said shapes belong.

The spacing between consecutive shapes, i.e., the pitch of the arrangement of shapes 2 in their frame 3, is 0.043 m, corresponding to a passage opening of about 0.02 m and, for a thickness of the element of 0.05 m, and consequently a rib width of about 0.048 m, it can be seen, with the element being placed horizontally, that the vertical projection of the shapes completely covers the area delimited by the projection of frame 3, which means that a particle, under the effect of gravity alone, will necessarily encounter at least two ribs of a shape, except in the particular case mentioned below.

The shapes of the two ends of a row constituting an element comprise a single rib so as not to cause clogging to start: in FIG. 1, the first left half-shape consists of an upper rib **4*s*, and that on the right a lower rib 4*i*, their upper edges being spot-welded to frame 3**, just like the ends of each of the ribs.

Figure 2:
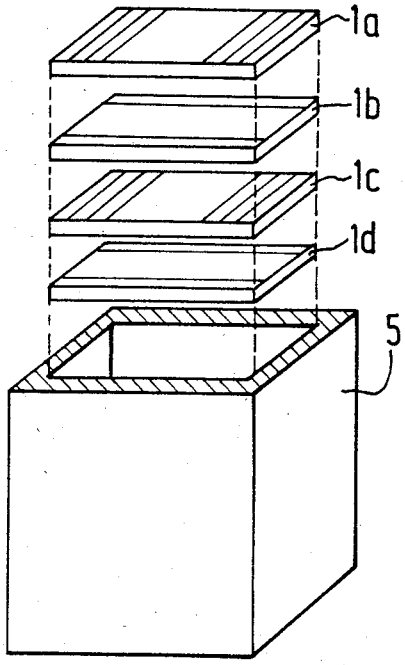
FIG. 2 is an exploded view, in perspective, illustrating a preferred mode of stacking the packing elements according to FIG. 1, on the inside of a heat insulated enclosure.

FIG. 2 shows an exploded view in perspective, of a preferred mode of stacking elements 1 in a heat insulated parallelepipedal enclosure 5. The orientations of the elements correspond to an angular offset of 90°, always in the same direction, from element **1*a* to element 1*b*, then successively to elements 1*c*, 1*d*, and possible subsequent ones, so that the effect of the half-shapes of end 4*i* and 4*s*** are cancelled every 4 elements.

To illustrate the performances of this type of packing, there are indicated below the results obtained with the lamellar particles mentioned above in a column 0.5 $m^2$ in section falling through a column comprising 20 of the elements described, i.e., 1 meter in height.

These particles are cooled by pouring them at the top of the column, with a distributor assuring alternating sweeping of the entire surface of the upper element. At a delivery of 1480 kg/h of particles at 625° C., with a countercurrent of 1275 $Nm^3$/h of air at 29° C. ($Nm^3$ or normal $m^3$, expressing a gas volume brought to 20° C. under one atmosphere), there are observed at the output, after starting of operation of the column, a temperature of 140° C. for the particles 470° C. for the cooing air, the pressure drop being on the order of 35 to 40 mm of a column of water. The efficiency of the exchanger, according to these operating data, is on the order of 3.25 ENTT (ENTT signifying "Equivalent Number of Theoretic Trays" of exchange, whose mode of calculation is defined, for example, in a report given at the "International Fluidizing Congress," held in Tokyo in May 1983, by J. F. LARGE, P. GUIGON and E. SAATDJIAN, titled 'Multistaging and solids distributor effects in a raining packed bed exchanger").

The use of this same device for heating of particles of the same type made it possible to make the following observations: for 1750 kg/h of schist particles to be heated from 10° to 430° C. by air at 620° C., a delivery of 1160 $Nm^3$/h of air was used and its temperature was found to be reduced to 130° C. at the output, the efficiency thus being able to be estimated at 2.22 ENTT. The pressure drop in this test was between 55 and 60 mm of a column of water.

By comparison, glassmaking sand with a granulometry of 100–400 μm (with a median of about 205 μm) was heated. With air heated to 610° C., at a delivery of 690 $Nm^3/h$, the sand, at a delivery of 980 kg/h, was found to have been brought from 12° C. to 485° C., the air temperature being found to be reduced to 135° C., with a pressure drop on the order of 30 mm of a column of water.

The efficiency can therefore be estimated at 2.75 ENTT.

The devices according to this example, therefore, have shown themselves, with a relatively small number of elements, and consequently with a very moderate size, to have a good efficiency, even for materials with fine, close granulometry, for which, however, Pall ring packings are capable of superior performances (about 4 ENTT).

The reliability of operation of these devices in a very broad range of granulometry recommends them particularly for using the process described in U.S. Pat. No. 4,450,895, using an exchange between very fine particles in suspension in a carrier gas and particles of large granulometry.

In regard to the use of the shapes described above, it will be noted that use of frames 3 in the form of cylindrical ferrules, and no longer of rectangular or square frames, will be preferred particularly for small units, for which heat losses will thus be reduced, while, to increase the treatment capacity of this type of devices, instead of increasing the section of the elements and, consequently, the length of the shapes, to the detriment of their geometric stability, preferably the choice will be to resort, to make the column elements, to prefabricated mosaics of partial elements, of a simple form, which can be stacked in successive layers, being combined in a way similar to that described for the stacking of simple elements.

Figure 3:
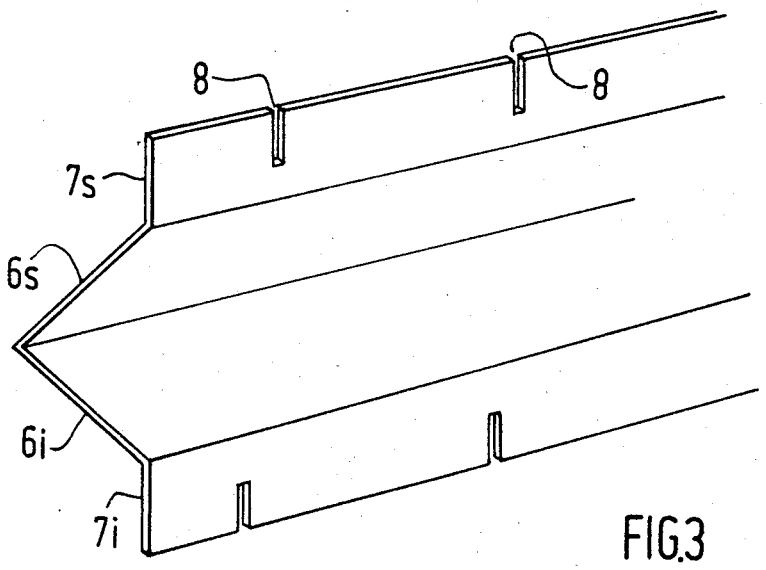
FIG. 3 is a partial view, in perspective, of an embodiment of a shape according to the invention provided with assembly notches.

Another embodiment of a packing according to the invention, derived from the preceding one, provides shapes in which, as shown in FIG. 3, two V ribs 6*s* and 6*i* are respectively connected to flanges 7*s* and 7*i*, located in the same vertical plane, for each shape, these flanges being provided with notches 8 of a width slightly greater than the thickness of the sheet metal used, and of a depth equal to half the width of said flanges.

Such a form of the shapes makes it possible to construct, layer by layer, i.e., element on element, the final packing, imposing an angular offset of 90° between notches. Moreover, it is favorable to the rigidity of the unit, while allowing the play necessary for differential expansions that can occur within the packing.

Half-shapes are provided for the ends of each layer, according to the principle already described above, the final assembly being done with spot-welding.

Another embodiment of the shapes is proposed which aims at avoiding anisotropy of circulation of the solid and gas flows resulting from the dissymetry of the shapes of the preceding examples.

Figure 4:
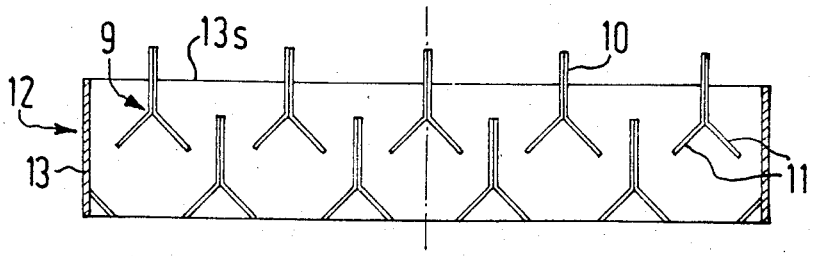
FIG. 4 is a partial view, in elevation, in section by a plane orthogonal to the shapes, of a packing element with "lambda-section" shapes.
Figure 5:
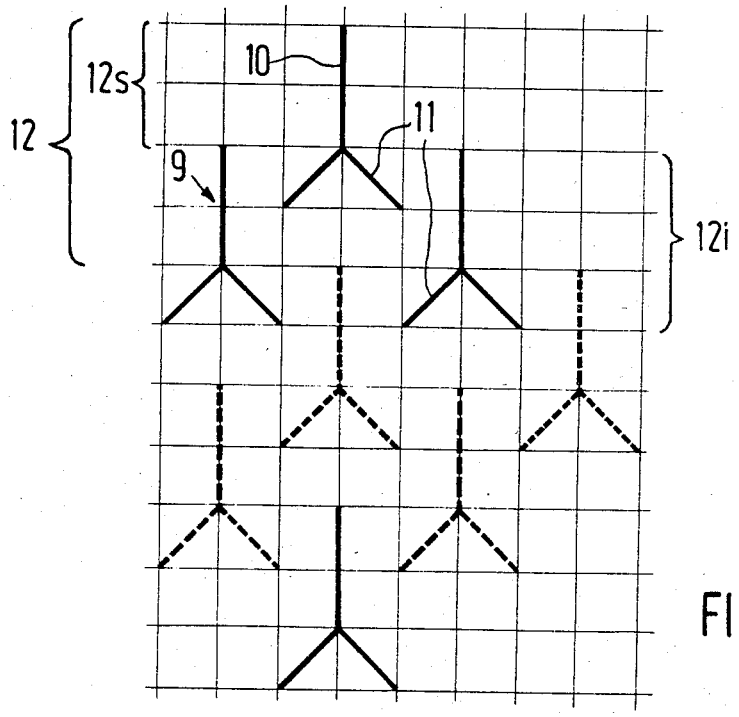
FIG. 5 is a similar partial view, on a larger scale, showing the structure obtained by assembling several elements of the same type as that shown in FIG. 4.

This form exhibits a section hereafter called "lambda," each shape 9 comprising, as shown in FIGS. 4 and 5, a vertical upper rib 10 and two lower ribs 11, which are symmetrical in relation to rib 10 forming, with it, an angle at least equal to 90°.

Each stacking element 12 comprises two layers 12*s* and 12*i* (FIG. 5) of these shapes, the shapes of one of the layers being inserted between those of the other, said shapes being fastened by their ends to frame 13 three of whose walls can be seen in FIG. 4.

To constitute an exchanger, elements 12 are stacked on one another, in the way illustrated diagrammatically in FIG. 5, i.e., the arrangement between shapes of two superposed layers being identical within the same element and from one element to the next, to the benefit of the compactness of the apparatus.

However, it is desirable to provide at least one time, and more generally an odd number of times, an angular offset of 90° between two consecutive elements, to reduce the risks of desegration in space, particularly resulting from the characteristics of the mode of distribution of the solid particles at the top of the packing. In this case, advantageously the length of the vertical upper ribs of the element above which is placed an angularly offset element will be brought to a level at most equal to that of the upper edge 13*s* or frame 13.

Figure 6:
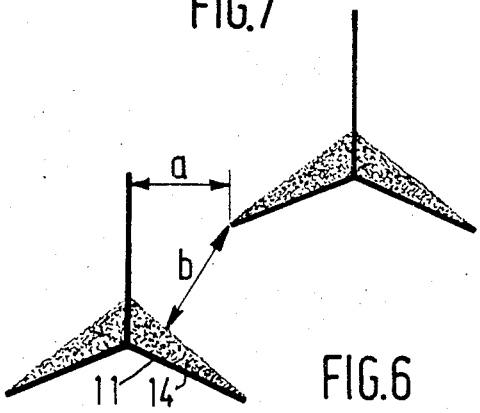
FIG. 6 is a diagrammatic view of two neighboring shapes, belonging to each of two layers of the same element, illustrating the mode of determining the geometric parameters of an element of a "lambda-section" shape.

The geometry of the "lambda" shapes meets the general rules stated in the description of this application, particularly in regard to the slope of lower ribs 11, generally chosen to be between 0.8 and 1.2 times the slope of the angle of talus of the material to be treated, and also for the passage opening between shapes. To determine the minimal value of said opening, it is advisable to consider the thickness of material that can stagnate on the ribs with a slope less than that of the talus of the falling material, and it is possible, on the other hand, to reduce the minimal value, about $\frac{1}{3}$, when the passage under consideration relates to a vertical rib. In this spirit, for example, the value of magnitude "a" shown on FIG. 6 can be allowed to be a third less than that of magnitude "b," measured by taking into account the possible presence of a talus 14 on rib 11.

On the other hand, vertical upper rib 10 of a shape of the lower layer of an element preferably reaches at least the level of the lower end of lower ribs 11 of the shapes of the upper layer.

To illustrate the performance of this type of packing, there are indicated below the results obtained with a column 0.5 $m^2$ in section and 1 m high comprising elements comprising shapes consisting of an upper rib 10 of 0.025 m, and two lower ribs 11 of 0.0175 m forming, between them, an angle of 90°. The pitch of the distribution of the shapes is 0.05 m and the difference in level between two successive layers is 0.025 m . The column comprises 19 elements, with an angular offset of 90° at the tenth element.

A delivery of 1760 kg/h of the same schist particles as those used in the first embodiment can be heated from 12° to 380° C. with the aid of 1150 $Nm^3/h$ of fumes at 600° C. A pressure loss of 104 mm of a column of water is observed.

It has been found that this type of shapes is to be applied in a particularly advantageous way when it is desired to obtain dedusting of the solid at the same time that it is subject to exchange. The phenomenon of granulometric segregation thus profitably used seems, in great part, to result from the type of progress of the gas flow that is established within the packing, as a result of the variation from 1 to 2 of the free section offered to said flow at each layer of shapes.

Figure 7:
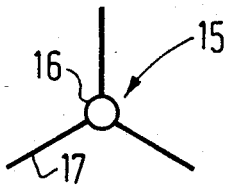
FIG. 7 is a diagammatic view, in section, of a "lambda-section" shape, comprising a tubular central core.

In a variant of this structure, described in FIG. 7, the invention provides shapes 15 comprising a central core, consisting of a tube 16 and carrying three radial ribs 17 similar to those of the "lambda-section" shapes. Central core 15 can optionally have the sole object of reinforcing the mechanical rigidity of the shape, but it can also be advantageously used for circulation of a heat-carrying fluid.

An application of these shapes, resorting to such a circulation, can be used in the device of the type described by French Pat. No. FR-A-2 452 689, comprising finned tube banks through which a thermofluid travels in series by successive horizontal layers and upward, to feed one or more boilers.

Another application of these shapes with finned ribs can advantageously be used to control the endo- or exothermic phenomena in chemical or physicochemical processes (adsorption and desorption) between solid and gas phases circulating countercurrent. To the first function, according to the principle of the invention, of putting solid and gas phases in optimal direct contact, can also be added a second exchange function, aimed at bringing energy in situ in case of endothermic reactions or removing it in case of exothermic reactions, these exchanges then being performed without direct contact, by means of the packing through which said heat carrier travels.

I claim:

1. A column for directly contacting a gas current moving in a first vertical direction with solid particles circulating countercurrent thereto in said first vertical direction, said column including packing stages each comprising at least two stacking elements, superimposed upon one another in said first direction, each of said stacking elements occupying the entire inner section of said column; and a plurality of shaped elements in each of said stacking elements, said shaped elements for each said stacking element comprising at least two ribs forming therebetween an angle sufficient to change the direction of gas and solid particles impinging thereon and being aligned in rows and regularly spaced transverse to said first direction, said spacing being such that said shaped elements of each said stacking element overlap one another to form a screen covering said entire inner section of said column when seen along said first direction, said spacing also being such as to form a passage for said solid particles, said passage being between 3 to 20 times the average grain size of said particles.

2. Packing according to claim 20, wherein said passage between two neighboring shaped elements is at least two times the largest dimension of said solid particles.

3. Packing according to claim 1, wherein the ribs have a width between 1 and 4 times that of said passage.

4. Packing according to one of claims 1 and 3, wherein the slope of at least one of the ribs of each shaped element is selected to be less than 1.5 times the slope of the angle of talus of the solid particles to be treated.

5. Packing according to claim 4, wherein, for treating very abrasive particles, the slope of one of the ribs is less than 0.8 times the slope of the angle of talus of said particles.

6. Packing according to claim 4, wherein the slope of at least one of the ribs of each shaped element is between 0.8 and 1.2 times the slope of the angle of talus of the particles to be treated.

7. Packing according to claim 1 wherein said shaped elements are arranged so that the entire vertical plane parallel to said shaped element cuts two ribs of the same element along a shaped element generatrix.

8. Packing according to claim 1 wherein the shaped elements of one stacking element are not parallel to the shaped elements of the immediately neighboring stacking elements.

9. Packing according to claim 1 wherein, in the absence of symmetry of the ribs of each shaped element in relation to a vertical plane parallel to the shaped elements, the superposed stacking elements exhibit an angular offset of such magnitude and sign that the sum of the angular offsets of the stacking elements is equal to a multiple of 360°.

10. Packing according to claim 9, wherein the number of stacking elements comprises is a multiple of 4, each element being oriented, in relation to its immediate neighbor, with an angular offset of 90°.

11. Packing according to claim 9, wherein the shaped elements are provided with notches making it possible to maintain the shaped elements of the stacking element or elements in an immediately adjacent position.

12. Packing according to claim 4 wherein said shapes have a V-section, the legs of each said V-section being located on the same side to relation to a vertical plane going through a summit thereof.

13. Packing according to claim 12, wherein said legs are symmetrical in relation to a horizontal plane going through the summit of V-section shapes.

14. Packing according to one of claim 4 wherein said shaped elements comprise lambda-section shapes comprising a vertical upper rib and two lower ribs symmetrical in relation to said upper rib and forming with said upper rib an angle at least equal to 90°, said shaped elements being placed in two layers on the inside of the same stacking element.

15. Packing according to claim 14, wherein the vertical upper rib of a shaped element of a lower layer of a stacking element reaches at least the level of the lower edge of the lower ribs of the shaped elements of an upper layer.

16. Packing according to claim 15 wherein said stacking elements comprise shaped elements comprising a tube, said tube forming a hollow central core, and three radial ribs forming fins.

17. Packing according to claim 16, wherein said tube contains a heat-carrying fluid.

18. Packing according to claim 17, wherein the tubes of said shaped elements are fed by a fluid having a temperature different than the solid and gas phases in contact with the shaped elements, to control the endo- and exothermic phenomena, respectively, in processes occurring between said phases.

* * * * *